US007049500B1

(12) United States Patent
Szczech et al.

(10) Patent No.: US 7,049,500 B1
(45) Date of Patent: May 23, 2006

(54) PORTABLE PEDAL EXTENSION, STEP, FOOTREST, AND BRIEFCASE FOR SMALL PIANISTS

(75) Inventors: Theodore Joseph Szczech, Woodbury, MN (US); Jane Jeong Trenka, Saint Paul, MN (US)

(73) Assignee: Theodore J. Szczech, Woodbury, MN (US)

( * ) Notice: Subject to any disclaimer, the term of this patent is extended or adjusted under 35 U.S.C. 154(b) by 175 days.

(21) Appl. No.: 10/805,865

(22) Filed: Mar. 22, 2004

(51) Int. Cl.
*G10C 3/26* (2006.01)

(52) U.S. Cl. ..... 84/232
(58) Field of Classification Search ..... 84/229–232

See application file for complete search history.

(56) References Cited

U.S. PATENT DOCUMENTS

| | | | | |
|---|---|---|---|---|
| 2,030,929 | A * | 2/1936 | Miyashita | 84/232 |
| 2,213,800 | A | 9/1940 | Ege et al. | |
| 2,245,314 | A * | 6/1941 | Willis et al. | 84/232 |
| 2,454,969 | A * | 11/1948 | Kaufman et al. | 84/232 |
| 2,463,910 | A | 3/1949 | Rydstrom | |
| 4,418,604 | A | 12/1983 | Kim | |
| 4,656,914 | A * | 4/1987 | Weisser et al. | 84/232 |
| 5,039,054 | A | 8/1991 | Pai | |

* cited by examiner

*Primary Examiner*—Jeffrey W Donels

(57) ABSTRACT

A pedal extension, step, and footrest serves as a lightweight briefcase that is portable from piano to piano by a child, and yet enables small pianists to properly use the damper pedal on a piano. The simplicity of the footrest and pedal extension enables a child to operate it without the need for adult supervision. Moreover the inventive footrest and pedal extension universally fits modern pianos.

7 Claims, 3 Drawing Sheets

PORTABLE PEDAL EXTENSION, STEP, FOOTREST, AND BRIEFCASE FOR SMALL PIANISTS

CROSS-REFERENCE TO RELATED APPLICATIONS

Not Applicable

FEDERALLY SPONSORED RESEARCH

Not Applicable

SEQUENCE LISTING OR PROGRAM

Not Applicable

FIELD OF THE INVENTION

This invention relates to piano pedal extensions, which are used by children or people with short legs.

BACKGROUND

The damper pedal on a piano is critical for a pianist to properly play a musical piece. Most people can reach the damper pedal. However, children and people with short legs have difficulty reaching the damper pedal. This difficulty results in improper use of the damper pedal.

Prior to the twentieth century, small pianos were manufactured for children. As the piano manufacturing industry became more standardized, however, pianos for children were phased out in favor of full-sized pianos.

Thereafter, numerous inventors created several types of pedal extensions to help children and people with short legs to reach the damper pedal of full-sized pianos. Prior art patents going back to 1886 were perused. None of the patents perused meet the modern needs of small pianists. This can be shown, for example, by examining the following recent patents: U.S. Pat. No. 2,213,800 to Ege, et al (1939); U.S. Pat. No. 2,463,910 to Rydstrom (1947); U.S. Pat. No. 4,418,604 to Kim (1983); and U.S. Pat. No. 5,039,054 to Pai (1991).

The prior pedal extensions are too heavy or large to be portable by children. The prior pedal extensions cannot be attached and adjusted by a student without adult assistance. However, a child may be disqualified if assisted by an adult in some contests and auditions. Some prior pedal extensions are suitable either for a grand piano or an upright piano, but not both. The prior pedal extensions cannot be used as a briefcase. However, books must be carried to a lesson. Thus, there's a need for a portable pedal extension that can combine these functions. The pedal extension should be easily transportable to any piano for lesson, practice, or performance. In summary, none of the prior pedal extensions meet today's needs for small pianist to properly play a full-sized piano.

OBJECTS AND ADVANTAGES OF THIS INVENTION

Several objects and advantages of this pedal extension are:

(a) to provide an extension to the damper pedal for small pianists;

(b) to provide a step;

(c) to provide a footrest;

(d) to serve as a lightweight briefcase;

(e) to fit all modern pianos;

(f) to be used by children without adult assistance.

Further advantages will become apparent from a consideration of the ensuing description and drawings.

SUMMARY

This pedal extension is comprised of a rectangular box for use by small pianists. It has three uses:

1. The box attaches to the una corde and sostenuto pedals of a piano. These pedals are slipped between an elastic cord and a pressure bar. The front of the box also has adjustable feet to provide additional force to hold the pressure bar against the pedals. This holds the box in place so small pianists can use it both as a step to reach the piano bench and a footrest.

2. It is a pedal extension for small pianists to correctly utilize the damper pedal on a piano. It consists of an extension pedal that is attached to the top of the box by a hinge. Connected to this extension pedal is a push rod that extends down through a slot in the top surface of the box. On the lower end of this push rod is a push knob that rests upon the piano's damper pedal. The length of the push rod can be changed so that the extension pedal is at a convenient operating height. By pressing and releasing the extension pedal, the pianist is able to operate the damper pedal.

3. The box is lightweight, hollow, and has a handle and fabric bag so it can be used as a briefcase to carry music books and other items.

DRAWINGS—FIGURES

The pedal extension will be further explained with reference to the drawings.

Figure 1:
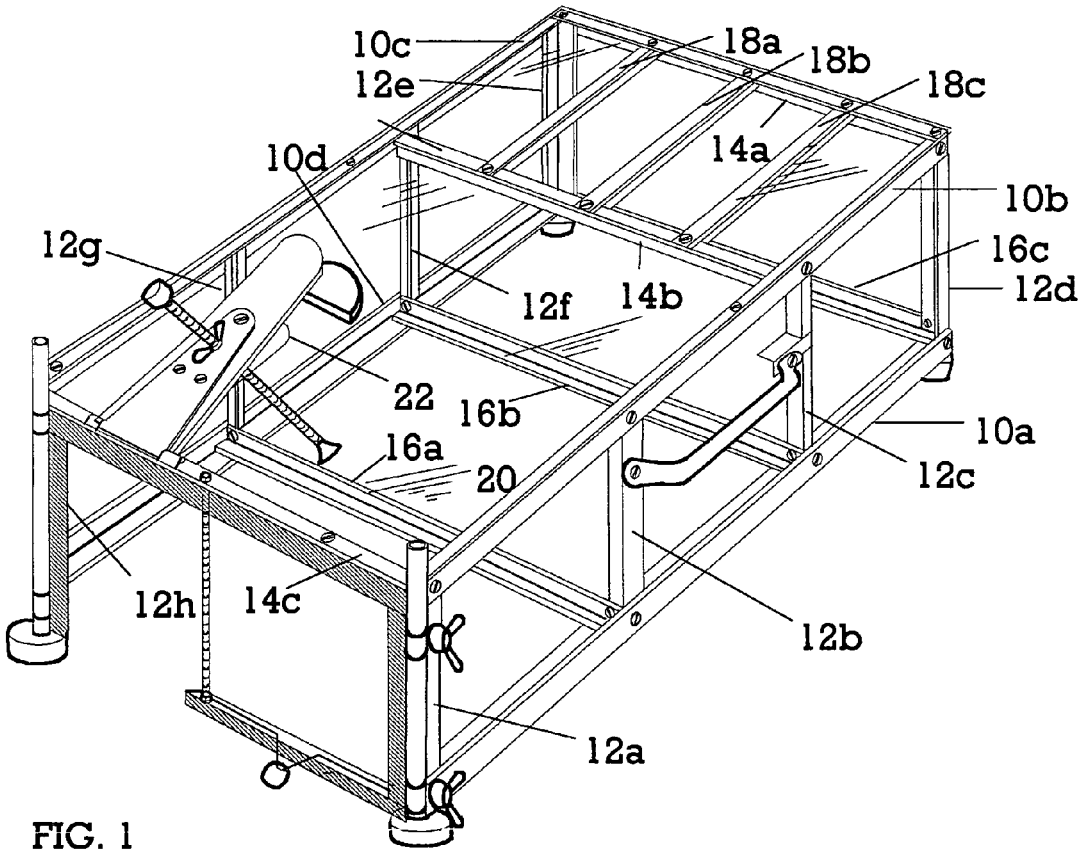
FIG. 1 is a perspective view of the front end of the pedal extension showing the components of its rectangular box.

These figures are not precisely to scale and are intended to be merely illustrative and non-limiting.

DRAWINGS—REFERENCE NUMERALS

10*a*–10*d* longitudinal bar
12*a*–12*h* vertical bar
14*a*–14*c* upper-cross bar
16*a*–16*c* lower-cross bar
18*a*–18*c* upper-rear-reinforcing bar
20 rigid-plastic sheet
22 oblong slot
22 una corde pedal
24 sostenuto pedal
28 damper pedal
30 grip knob
32 elastic cord
34 pressure bar
36 attachment rod
38*a*–38*d* strap and wing nut

40*a*–40*b* height-adjustable rod
42*a*–42*b* front foot
44*a*–44*b* rear foot
46 wing nut
48 adjusting knob
50 threaded rod
52 hinge plate
54 push knob
56 extension pedal
58 hinge
60 rubber pad
62*a*–62*d* rubber-sheet
64 handle
66 extension bar
68 fabric storage bag

ILLUSTRATIVE EMBODIMENT—FIGS. 1, 2, AND 3

Design and Construction of the Rectangular Box

FIG. 1 illustrates a perspective view of the front end of this embodiment. This embodiment is in part a rectangular box constructed of right angle aluminum bars. The bars are screwed together to form a lightweight, strong frame. The frame must be long enough to reach from the front of the piano pedals to the pianist's feet to provide a comfortable footrest, but not so long as to put the pianist uncomfortably far from the piano. The length of the box is determined by longitudinal bars 10*a* to 10*d*, which in this embodiment is approximately 41 cm. The height of the frame must be such to provide small pianists comfortable access to the extension pedal. The height of the box is determined by vertical bars 12*a* to 12*h*, which in this embodiment is approximately 12 cm. The assembly is done by screwing bars 12*a* to 12*d* to bars 10*a* and 10*b*, and bars 12*e* to 12*h* to bars 10*c* and 10*d*. The width of the frame must accommodate the three pedals of all pianos. The width is determined by the upper-cross bars 14*a* to 14*c* and the lower-cross bars 16*a* to 16*c*, which in this embodiment is approximately 29 cm. Next the box is assembled by screwing bars 14*a* to 14*c* to bars 10*b* and 10*c*, and bars 16*a* to 16*c* to bars 10*a* and 10*d*. The frame must be sufficiently sturdy to permit a pianist to step on the box to reach the piano bench (not shown). Thus, upper-reinforcing bars 18*a* to 18*c* are screwed to the upper-cross bars 14*a* and 14*b*. The upper surface of the rectangular box consists of a rigid-plastic sheet 20 screwed to the frame. In this embodiment, the plastic sheet 20 is approximately 1.6 mm thick. There is an oblong slot 22 cut into the plastic sheet 20 to allow access to the damper pedal. In this embodiment the oblong slot 22 is approximately 8 cm long by 1 cm wide.

Figure 2:
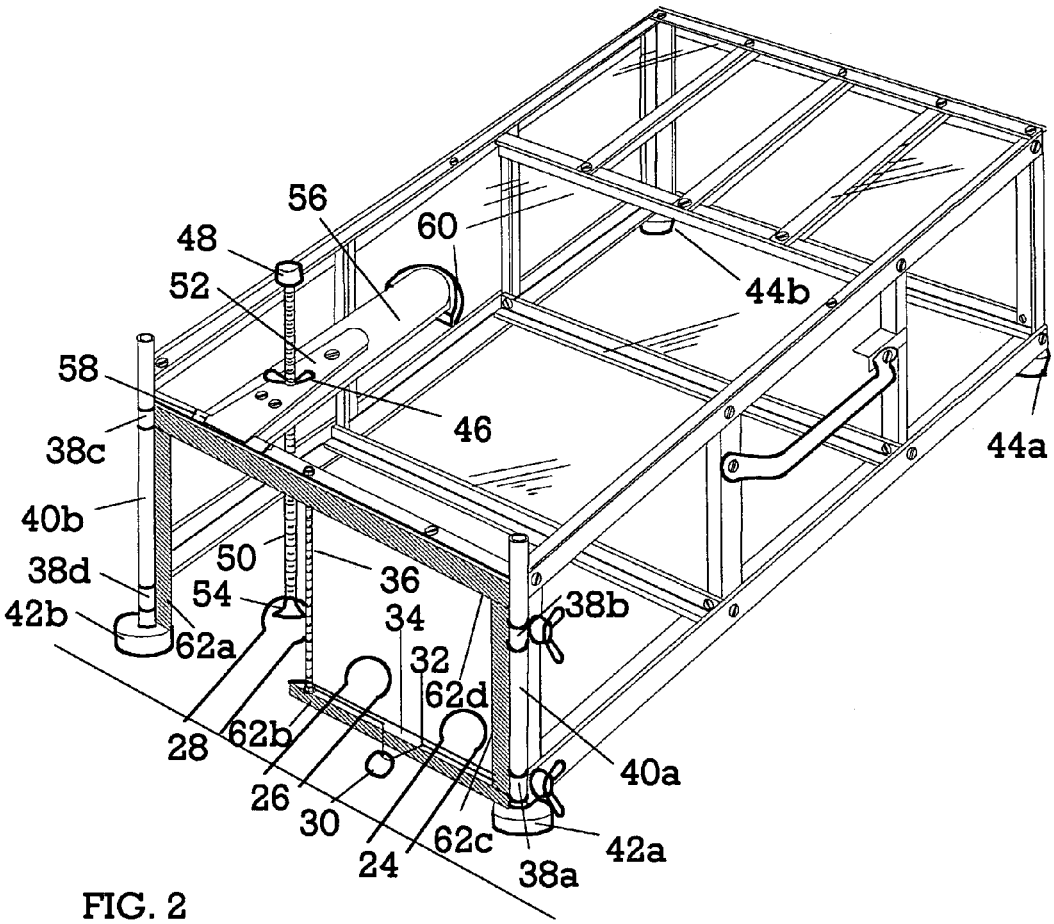
FIG. 2 is a perspective view of the front end of the pedal extension showing the elastic cord on top of the una corde and sostenuto pedals, the pressure bar under these pedals, and the push knob of the extension pedal engaging the piano damper pedal.

Design and Construction for Attachment of Embodiment to Piano, and of Extension Pedal Mechanism FIG. 2 illustrates a perspective view of this embodiment showing its relationship to a piano's pedals when in use. The piano pedals are the una corde 24, the sostenuto 26, and the damper 28. The grip knob 30 is tied to the elastic cord 32 with a knot through a hole in the knob. The elastic cord 32 is wound about the pressure bar 34 to secure it to the pressure bar. The pressure bar 34 is screwed to the vertical bar 12*a* (FIG. 1) and the attachment rod 36. The length of the pressure bar 34 is about 15 cm. The attachment rod is threaded and attached with nuts to cross bar 14*c* (FIG. 1).

Also shown in FIG. 2, are strap and wing nut assemblies 38*a* to 38*d*. The straps of these assemblies 38*a* to 38*d* secure the height-adjustable rods 40*a* and 40*b* to vertical bars 12*a* and 12*h* (FIG. 1) and when loosened allow the height of the rods 40*a* and 40*b* to be changed. The rods 40*a* and 40*b* are attached to the front feet 42*a* and 42*b*. The rear feet 44*a* and 44*b* are screwed to longitudinal bars 10*a* and 10*b* (FIG. 1).

FIG. 2 further shows the wing nut 46 and the adjusting knob 48 on the threaded rod 50. The threaded rod 50 is screwed through the threaded hinge plate 52 and the extension pedal 56. The push knob 54 is screwed onto the end of the threaded rod 50. The hinge plate 52 is screwed to the extension pedal 56, and the hinge 58 of the hinge plate 52 is screwed to the upper bar 14*c* (FIG. 1). This essentially attaches the extension pedal 56 to the box via the hinge 58. The rubber pad 60 is glued to the plastic sheet 20 (FIG. 1) beneath the pedal 56. Rubber-sheeting 62*a* to 62*d* is glued to the front surfaces of bars 12*a*, 12*h*, 14*c*, (FIG. 1) and pressure bar 32.

Design of the Briefcase

Figure 3:
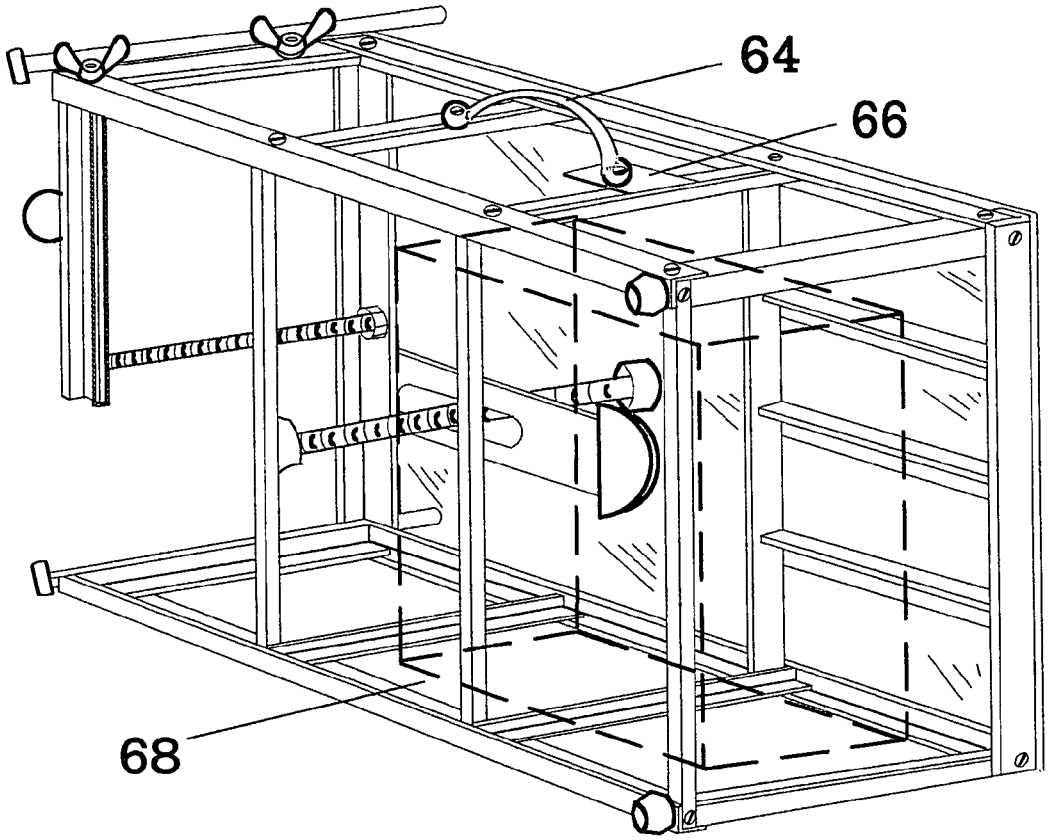
FIG. 3 is a perspective view of the back end of the pedal extension showing a dotted outline representing a fabric bag which can be used to store books and other items. The pedal extension is shown in the position in which it would be carried by its handle.

FIG. 3 shows the position of the box when used as a briefcase. It shows the handle 64 screwed to the vertical bar 12*b* (FIG. 1) and the extension bar 66. The extension bar 66 is screwed to the vertical bar 12*c* (FIG. 1). In the cavity of the box dashed lines show the fabric storage bag 68.

Operation of the Illustrative Embodiment—FIGS. 2 and 3

FIG. 2 illustrates a perspective view of this embodiment showing its relationship to a piano's pedals when in use. The piano pedals are the una corde 24, the sostenuto 26, and the damper 28. The grip knob 30 attached to the elastic cord 32 is used to lift the elastic cord over the una corde 24 and the sostenuto 26 pedals. The pressure bar 34 is positioned beneath the pedals 24 and 26. The elastic cord 32 is attached to the pressure bar 34 and secures the pressure bar 34 to the pedals 24 and 26. The pressure bar 34 is short enough so that it doesn't interfere with the operation of the damper pedal 28. The box must be positioned so that the push knob 54 contacts the outer end of the damper pedal 28. In this embodiment, the push knob 54 is plastic, round, and slightly convex so it can slide smoothly on the damper pedal 28. The push knob 54 is large enough (approximately 4 cm in diameter) so that it will not slip off the damper pedal 28.

To more securely attach the box to the pedals 24 and 26, the wing nut and strap assemblies 38*a* and 38*b* are first loosened. The box is lifted up against the pedals 24 and 26. The left height-adjustable rod 40*a* is pushed downward so the front foot 42*a* presses strongly on the floor. The left strap and wing nut assemblies 38*a* and 38*b* are then retightened. Next, the right strap and wing nut assemblies 38*c* and 38*d* are loosened, the rod 40*b* pressed down as before and the right strap and wing nut assemblies 38*c* and 38*d* are retightened. In this embodiment the rear feet 44*a* and 44*b* are of fixed height. This gives the footrest an approximate total height of 14 cm from the floor. The height of the footrest from the floor is most critical. Preferably, heights ranging from about 10 cm to 20 cm have been found to be satisfactory. The front end of the box will usually be slightly higher than the back end because the adjustable feet are usually set higher than the fixed feet. It was discovered that this slight tilt angle makes the extension pedal more effective in operating the piano's damper pedal. All of the feet on this embodiment are made of soft plastic to minimize slip and to protect floors from scratches.

To adjust the extension pedal 56, the wing nut 46 is first loosened. This allows the adjusting knob 48 to be turned. The adjusting knob 48 is turned either clockwise or counterclockwise until the extension pedal 56 is at a comfortable operating height for the pianist. Also, the extension pedal 56 must be high enough so that the piano damper pedal 28 operates properly. The oblong slot 22 in the plastic sheet 20 is long enough to give a large range of motion to the threaded rod 50 and hence the extension pedal 56. After the height adjustment has been made, the wing nut 46 is securely tightened to keep the extension pedal 56 at the proper height. The damper pedal 28 is activated when the pianist presses the extension pedal 56. The pianist sits with his or her left foot on top of the plastic sheet 20. The right heel of the pianist's foot also sits on top of the plastic sheet 20 and the right toes operate the extension pedal 56. The rubber pad 60 beneath the extension pedal 56 quiets the sound of the extension pedal 56 when fully depressed. The rubber sheeting 62*a* to 62*d* not only protects the piano from scuffing but also provides sound deadening when the box is accidentally bumped.

To remove the invention from the piano, the height-adjustable rods 40*a* and 40*b* are loosened and pulled upward until they stop, and then are retightened. This eliminates the force on the pressure bar 34 caused by the contact of the front feet 42*a* and 42*b* with the floor. The invention can then be pulled away from the piano pedals. It can then be carried to another piano and the above procedure for its use repeated.

This embodiment is easily used as a briefcase. FIG. 3 shows the available storage space, which is approximately 34 cm long, 26 cm wide, and 9 cm high. This space accommodates a fabric storage bag 68. The total weight of this embodiment with the fabric storage bag is approximately 1.4 kilograms. This is light enough for small children to use as a briefcase when carried by the handle 64. When the pianist has arrived at his or her destination, the storage bag must be removed to use the extension pedal 56 since the storage bag can interfere with the action of the extension pedal 56.

ALTERNATIVE EMBODIMENTS

No effort has been made to optimize the current pedal extension for manufacture. There are various possibilities with regard to the current pedal extension's manufacture. For instance, the current pedal extension could be made from a variety of materials. Instead of a rigid plastic sheet 20 on an aluminum frame, the footrest and storage compartment could be made from extruded plastic or other materials. The storage compartment could be manufactured as a self-contained storage space needing no additional bag. The handle 64 could be replaced or supplemented by a shoulder strap or back straps. The dimensions of the footrest and the storage compartment could be changed both vertically and lengthwise to accommodate children ranging in size but not yet large enough to properly reach the piano damper pedal. However, the current pedal extension has been tested with many children. It has been found that the current dimensions work well for all of these test pianists. The human body is flexible at the ankle, knee, and hip. Therefore, one height fits most as one piano height fits most adult pianists.

ADVANTAGES

From the description above, a number of advantages this pedal extension become evident:

1) The fixed height of the box takes advantage of the human body's adjustability to eliminate unnecessary parts and weight.
2) The pedal extension is lightweight and portable.
3) The pedal extension can be used as a briefcase.
4) The pedal extension is sturdy enough for the pianist to use as a step.
5) The design universally fits all pianos.
6) The slight tilt of the pedal extension diminishes the force needed to operate the damper pedal.
7) The simplicity of use means that a small child can use it without adult assistance.
8) The pedal extension is safe to carry and use.
9) The simplicity of design implies low manufacturing cost and lower selling price than previous inventions.
10) The lightness will result in low shipping cost.

CONCLUSIONS, RAMIFICATIONS, AND SCOPE

It has been shown that this pedal extension can be used at piano lessons, contests, auditions, recitals, and in any other situation where a small person would like physical comfort and maximum control of the damper pedal of a piano. Furthermore, this pedal extension has the additional advantages:

1) It encourages proper posture at the piano, resulting in less physical strain and fatigue.
2) Pianists can bring this pedal extension everywhere. Small pianists will not be forced to make uncomfortable adjustments to pianos lacking a pedal extension device.
3) The use of this pedal extension means that a pianist can learn to use the damper pedal properly at an early age before being able to reach a piano's pedal.
4) The slight upward tilt of the footrest makes the piano damper pedal easier to operate via the extension pedal.

Although the description of this pedal extension contains much specificity, these should not be construed as limiting the scope of the pedal extension but as merely providing an illustration of the present embodiment of the pedal extension. For example, the box could be made of wood or plastic right angle bars, or with solid walls of extruded plastic. The storage space could be made self-contained rather than using a bag. Thus the scope of this pedal extension should be determined by the appended claims and their legal equivalents, rather than by the example given above.

The complete disclosure of all patents, patent documents, and publications are incorporated herein by reference as if individually incorporated. Various modifications and alterations of this pedal extension will become apparent to those skilled in the art without departing from the scope and spirit of this invention.

What is claimed is:

1. A pedal extension for small pianists on a multiple pedal piano, one pedal being a damper pedal, comprising:

(a) a rectangular box having a first side with four feet contacting a floor, a second opposing side forming a footrest; a front end facing the piano, two vertical sides separating the side with four feet from the footrest side at a usable height and to form a storage space within the box;

(b) a pressure bar on the front end of the box for fastening the box to at least one of the piano pedals;

(c) a push knob in contact with the piano damper pedal, said push knob on one end of a threaded rod disposed vertically through a slot in said footrest side;

(d) an extension pedal having a threaded hole therein, with said threaded rod screwed through the hole, wherein the extension pedal has one end fastened to the footrest side via a hinge, and (e) a rod-length-adjusting knob on the opposing end of said threaded rod, with said adjusting knob adjusted to lift the extension pedal from the footrest side.

2. The pedal extension of claim 1 wherein: the box is a portable briefcase.

3. The pedal extension of claim 2 further wherein: the box includes a handle, or a shoulder strap, or back straps.

4. The pedal extension of claim 1 further comprising:

height-adjustable feet mounted on each vertical side, wherein increasing the height of the adjustable feet increases the force of the pressure bar on at least one piano pedal.

5. The pedal extension of claim 1, wherein:

the damper pedal has an outer end; and the push knob is positioned near the outer end of the damper pedal to improve leverage.

6. The pedal extension of claim 1, wherein:

the container has a height between approximately 10 and 20 centimeters.

7. The pedal extension of claim 1, wherein:

the footrest side is reinforced to act as a step.

* * * * *